US006739005B2

(12) United States Patent
Davis

(10) Patent No.: US 6,739,005 B2
(45) Date of Patent: May 25, 2004

(54) BED WITH ADJUSTABLE ELEVATION COMPONENTS

(75) Inventor: Edmund Scott Davis, Fort Lauderdale, FL (US)

(73) Assignee: Banyan Licensing LC, Ft. Lauderdale, FL (US)

( * ) Notice: Subject to any disclaimer, the term of this patent is extended or adjusted under 35 U.S.C. 154(b) by 0 days.

(21) Appl. No.: 09/946,069

(22) Filed: Sep. 4, 2001

(65) Prior Publication Data

US 2003/0041378 A1 Mar. 6, 2003

(51) Int. Cl.[7] ..... A47C 17/00
(52) U.S. Cl. ..... 5/615; 5/691; 5/613
(58) Field of Search ..... 5/614, 615, 617, 5/618, 613, 691; D6/596

(56) References Cited

U.S. PATENT DOCUMENTS

| | | | | | |
|---|---|---|---|---|---|
| 3,426,373 | A | | 2/1969 | Scott et al. | 5/660 |
| 3,667,075 | A | | 6/1972 | Ballard et al. | 5/722 |
| 3,781,928 | A | | 1/1974 | Swallert | 5/660 |
| 4,309,783 | A | * | 1/1982 | Cammack et al. | 5/615 |
| 4,527,298 | A | | 7/1985 | Moulton | 5/615 |
| 4,639,960 | A | | 2/1987 | Quillen et al. | 5/710 |
| 4,685,163 | A | | 8/1987 | Quillen et al. | 5/710 |
| 4,839,932 | A | | 6/1989 | Williamson | 5/615 |
| 4,873,731 | A | | 10/1989 | Williamson | 5/615 |
| 5,170,522 | A | | 12/1992 | Walker | 5/615 |
| 5,345,630 | A | * | 9/1994 | Healy | 5/615 |
| 6,009,873 | A | | 1/2000 | Neviaser | 128/845 |
| 6,038,722 | A | * | 3/2000 | Giori et al. | 5/709 |
| 6,079,065 | A | | 6/2000 | Luff et al. | 5/618 |
| 6,336,235 | B1 | * | 1/2002 | Ruehl | 5/610 |
| 6,499,162 | B1 | * | 12/2002 | Lu | 5/618 |
| 6,505,365 | B1 | * | 1/2003 | Hanson et al. | 5/613 |

FOREIGN PATENT DOCUMENTS

| | | |
|---|---|---|
| DE | 30 16 914 A | 11/1981 |
| FR | 2 628 621 A | 9/1989 |
| FR | 2 732 203 A | 10/1996 |
| GB | 1 604 401 A | 12/1981 |

OTHER PUBLICATIONS

International Search Report, Dec. 2, 2002.

* cited by examiner

*Primary Examiner*—Robert E. Pezzuto
*Assistant Examiner*—Tara L. Mayo
(74) *Attorney, Agent, or Firm*—Alston & Bird LLP

(57) ABSTRACT

A bed with air adjustable elevation components having a generally rectangular foundation, a mattress having a plurality of sections, and an air chamber under each section of the mattress that is to be raised. The contour and shape of the mattress is controlled by inflating and deflating each air chamber to elevate and incline the section of the mattress. The mattress is formed of connecting sections including a back section and a buttock section adjacent the back section. Adjacent the buttock section is an upper leg section and adjacent the upper leg section is lower leg section. The sides of the upper leg section and the lower leg section abutting each other are formed at an angle such that when the leg sections of the mattress are in a non-elevated position a V-shaped cut out area is formed between the two sections. The air chambers are connected to a pump and a controller is provided to easily inflate and deflate the chambers, together or separately, with compressed air.

12 Claims, 3 Drawing Sheets

BED WITH ADJUSTABLE ELEVATION COMPONENTS

FIELD OF THE INVENTION

The present invention relates to a bed with adjustable components for raising and lowering the occupant's back and legs. More particularly, the invention relates to beds having adjustable back and leg sections and more particularly to an improved mattress construction for a bed with adjustable elevation components.

BACKGROUND OF THE INVENTION

Beds that are adjustable to change the posture of the occupant have been used for patients in hospitals or residents in nursing homes, especially for those patients who are nonambulatory. It is often necessary to provide a bed that can be adjusted by the patient to a variety of positions. For example, a patient returning from surgery may be required to avoid any strain until a certain healing process has progressed efficiently to allow ambulation. However, adjustable beds have grown beyond their use for nonambulatory patients and have been found desirable as a lifestyle product by many healthy people.

Unfortunately, adjustable beds found in the prior art range from beds provided with a mechanical crank at the foot to be adjusted by a person other an the occupant to pneumatic and electromechanical devices which control posture from controls operated by the occupant. However, the mechanical beds of the prior art are generally speaking cumbersome and expensive. Other types of adjustable beds, those using air mattresses, require some type of rigid frame between the air chambers and the mattress. Moreover, the mattresses must typically be held in place to bend to conform to the desired shape as sections are raised.

An example of an adjustable bed is disclosed in U.S. Pat. No. 5,170,522, which teaches a bed having a foundation for supporting an air mattress. The foundation has a plurality of pivotally connected transverse plates between the mattress and a foundation that are moved to bend the mattress to a desired contour and shape. The plates are caused to move by inflatable, flexible bags.

Another adjustable bed is shown in U.S. Pat. No. 4,527,298 which discloses a pneumatically adjustable bed. The elevation of the back and legs sections are aided by a four piece rigid bedboard which underlies the mattress and provides a hard surface against which the air bladders inflate to a particular area of the mattress. The sections of the bedboard are hinged together and configured to underlie an inflatable mattress. The mattress is held in place with a tie down strap.

SUMMARY OF THE INVENTION

It is a general object of the present invention to provide an adjustable bed having an elevated back section and an elevated leg section that may be used as a conventional mattress with a conventional bed frame and box springs.

Another object of the present invention is to provide a bed having a mattress formed in separate interconnecting sections for easy elevation that may be raised and lowered using inflatable air chambers under the section of the mattress to be raised.

Yet another object of the present invention is to provide a mattress having sections that may be separated from each other and packaged for easy shipment.

The present invention is directed to a bed with air adjustable elevation components having a generally rectangular foundation, a mattress having a plurality of sections, and an air chamber under each section of the mattress that is to be raised. The profile and shape of the mattress is controlled by inflating and deflating each air chamber to elevate and incline the sections of the mattress.

The mattress is formed in separate sections adapted to elevate portions of the body including the back and legs. In a preferred embodiment, a buttock section between the back section and the leg section is provided. The leg section preferably includes an upper leg section and adjacent lower leg section. The upper surface of each of the section of the mattress is generally rectangular. The sides of upper leg section and lower leg section abutting each other are formed at an angle such that when the leg sections of the mattress are in a non-elevated position a generally V-shaped cut out area is formed between the two sections. The sections are connected together by a fastening means such as a zipper or the like.

In a preferred embodiment, the air chambers are sized to fit into concave cut out portions on the underside of the back section and the lower leg sections. The air chambers are made of materials flexible elastomeric materials. The air chambers are connected to a pump and a controller is provided to easily inflate and deflated the chambers, together or separately, with compressed air.

Because of the ability of the sections of the mattress to easily articulate the mattress is able to readily conform to the users body. In addition, because the sections of the mattress may be separated one from the other, the mattress is easily packaged for shipment to a customer.

BRIEF DESCRIPTION OF THE DRAWINGS

Other objects, features and advantages of the invention will become apparent from the following detailed description of the invention taken in connection with the accompanying drawings, which are not necessarily drawn to scale, and wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 5:
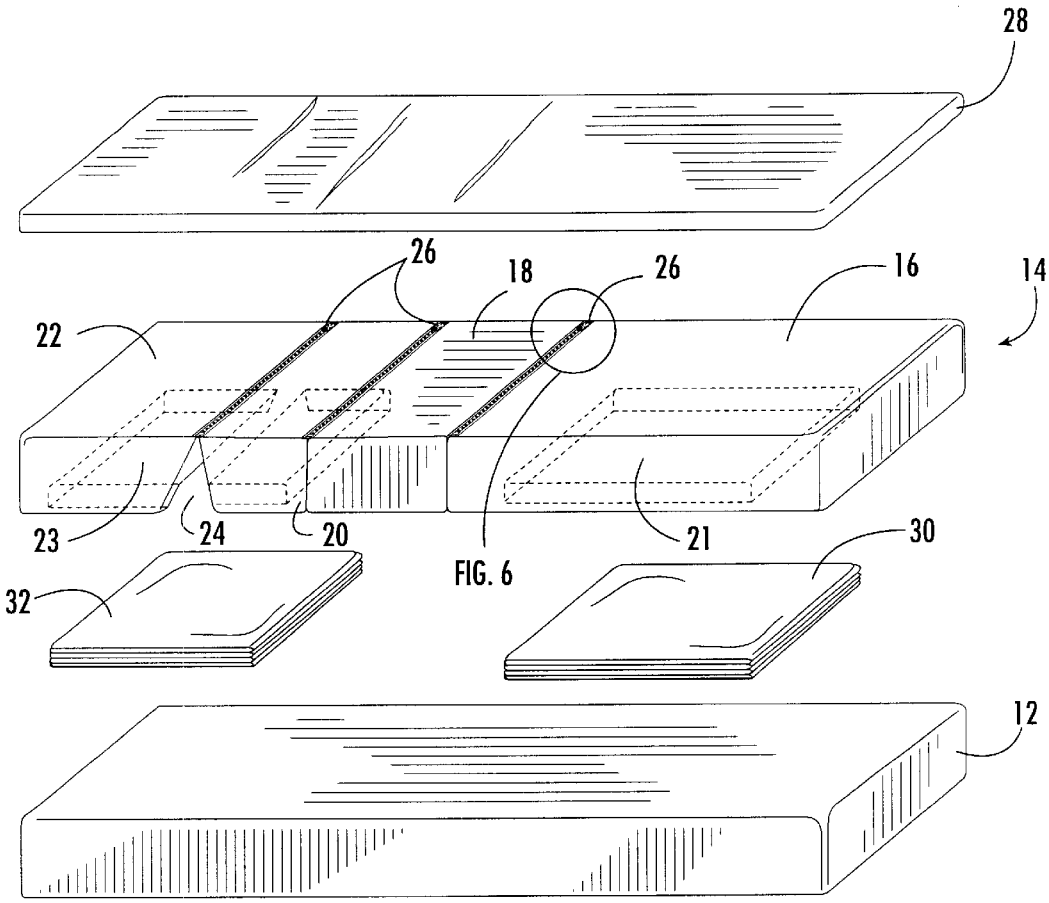
FIG. 5 is an exploded view of elements of the bed.

Referring to FIG. 5, there is shown a bed 10 with the air adjustable elevation components of this invention. The bed 10 is generally rectangular and has conventional box springs or other suitable foundation 12, a mattress 14 having a plurality of sections, and a pair of air chambers 30 and 32. The profile and shape of the mattress 14 is controlled by inflating and deflating air chambers 30 and 32 to elevate and incline sections of the mattress as desired to the comfort of the person resting on the mattress.

Figure 1:
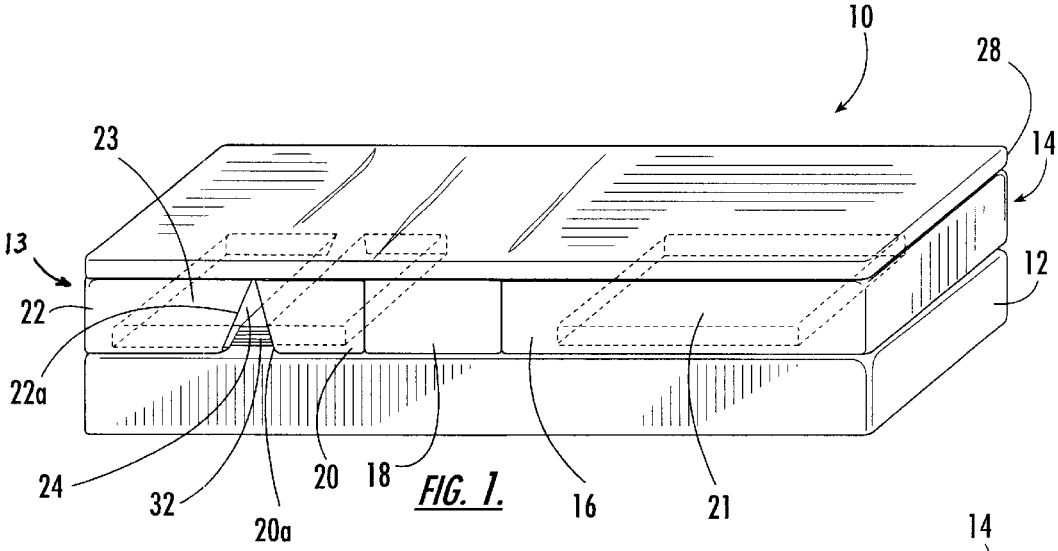
FIG. 1 is an isometric view of an adjustable bed of the present invention illustrating the mattress sections in an unraised or lowered position.

As shown in FIG. 1, the mattress 14 is formed in separate sections including a back section 16 and a leg section 13. In a preferred embodiment, the mattress 14 includes a buttock section 18 adjacent the back section 16. Adjacent the buttock section 18 is the leg section 13 that includes an upper leg section 20 and adjacent upper leg section 20 is a lower leg section 22. The upper surface of each section of the mattress is generally rectangular. The sides 20*a*, 22*a* of upper leg section 20 and lower leg section 22 abutting each other are formed at an angle such that when the leg sections of the mattress are in a non-elevated position a generally V-shaped cut out area 24 is formed between the two sides 20*a*, 22*a*. While there is shown the preferred V-shaped cut out area, it should be understood that any shaped cut out area that provides flexibility for the leg sections may be used.

Figure 3:
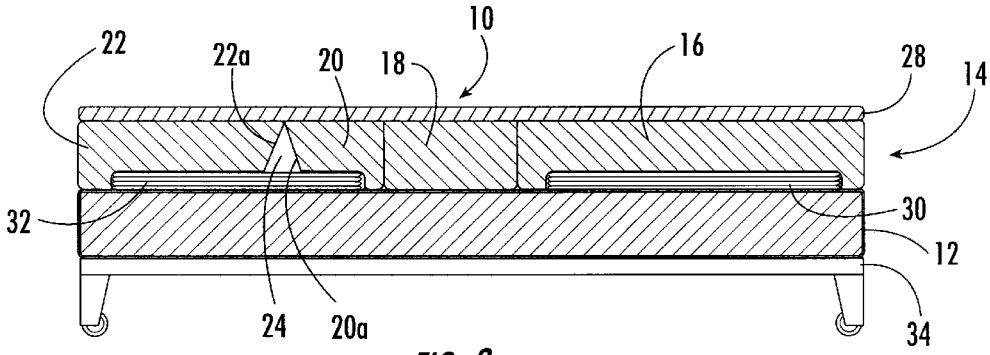
FIG. 3 is a side view showing the back section and leg sections in an unraised position.

The mattress is preferably made of flexible foam that is sufficiently resilient to comfortably support the user. Although the foundation 12, be it box springs or some other type of foundation, may sit on the floor, it is preferable that the foundation, as shown in FIG. 3, rest on a conventional bed frame 34 having downwardly projecting legs to support the bed above the floor. Also a conventional bedstead may be used.

Figure 6:
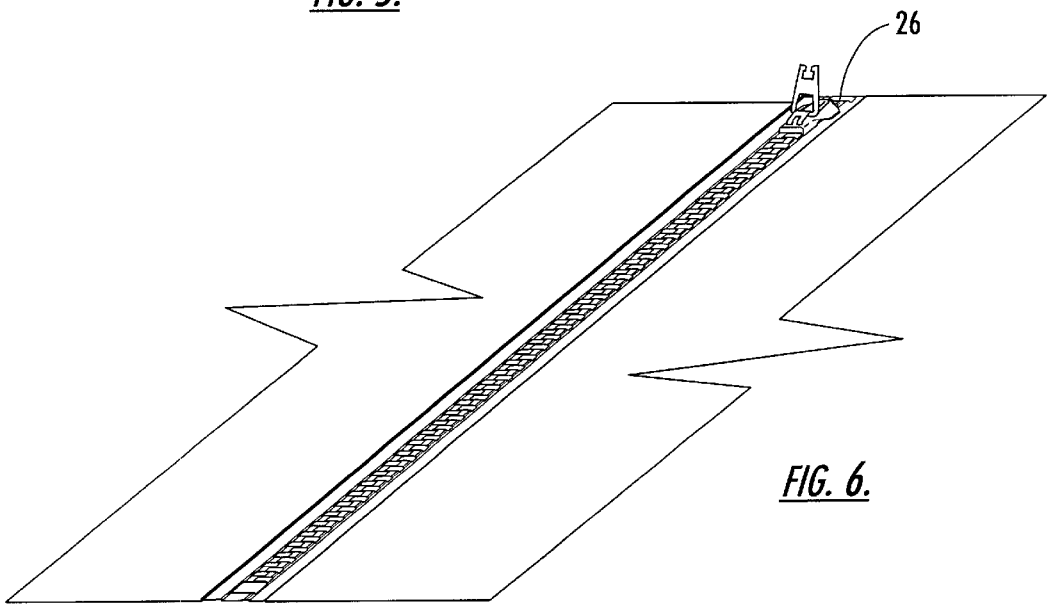
FIG. 6 is an enlarged view showing a preferred connection of the mattress sections.

As noted, the mattress sections are formed separately and connected together. The mattress sections may be connected to each other through any conventional means including hook and loop mechanisms like Velcro®, zippers or the like. However, the preferable means is to connect the sections together with a zipper 26, as shown in FIG. 6.

Figure 2:
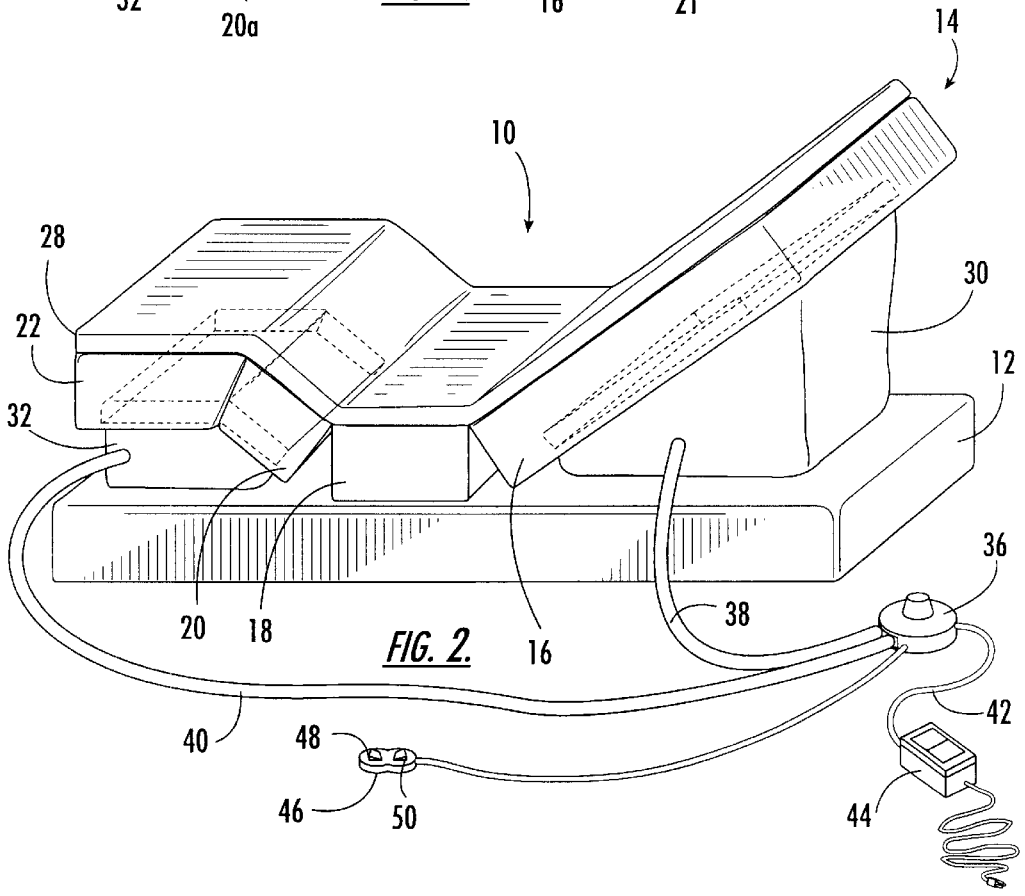
FIG. 2 is an isometric view of the adjustable bed of the present invention showing the back section and the leg sections in an elevated position.
Figure 4:
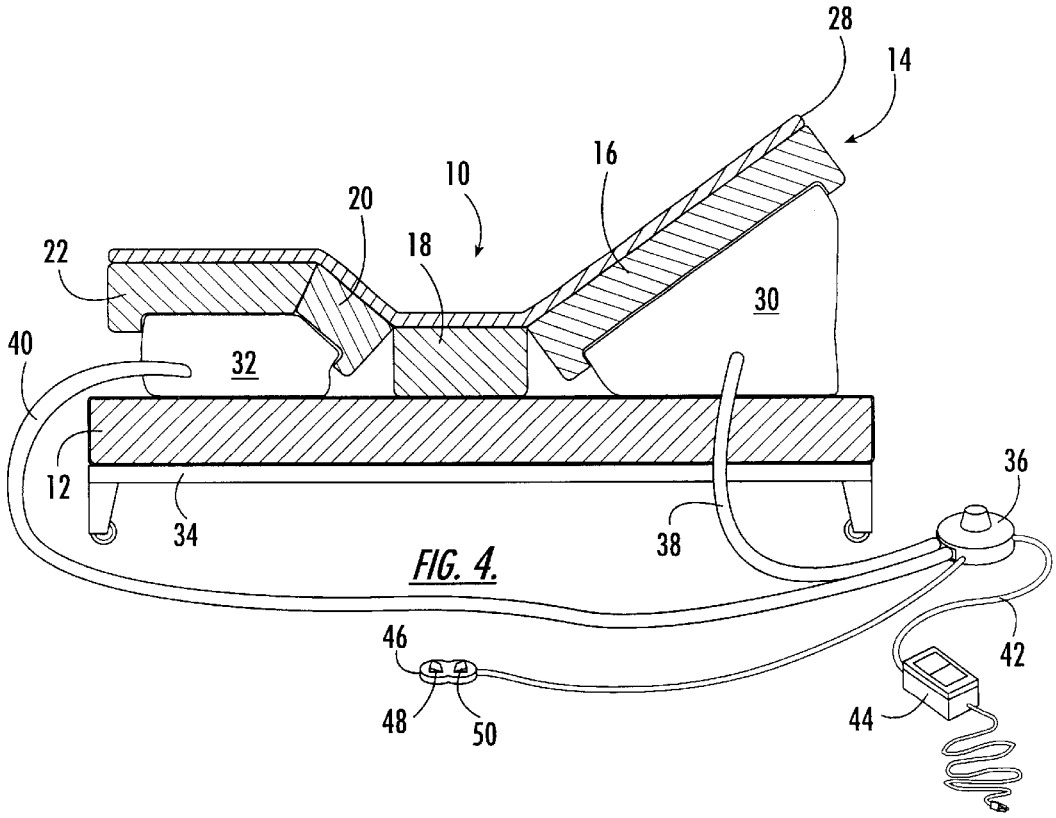
FIG. 4 is a side view showing the back sections and leg sections in an elevated position.

In order to accommodate the bed with air adjustable elevation components of this invention, the components for the bed 10 include a pair of chambers 30 and 32. As shown in FIGS. 2 and 4 the air chambers 30, 32 are shaped to accommodate the appropriate elevation of their respective sections. More specifically, the air chamber 30 has a generally wedge-shape or triangular shape and from the side perspective. The leg chamber 32 has a somewhat different shape as the upper and lower leg sections are articulated to provide the proper incline when in an elevated position. The chambers may be made of conventional materials known to those skilled in the art such as elastomeric materials. In one embodiment of the invention, that shown in FIGS. 3 and 4, a portion of the lower leg section 22 and the upper leg section 20 of mattress 14 have concave areas 21, 23 on the underside side thereof to hold deflated air chamber 32. In a like manner, the back section 16 also has a cut out concave area for holding deflated air chamber 30. As more clearly seen in FIG. 4, when the air chambers are inflated, the concave areas assist in maintaining the air chambers in position beneath their respective section.

As can be seen in the figures, the mattress 14 may be provided with a cushioning top layer 28 such as a mattress pad or flexible foam layer to provide continuity over the top surface of the various interconnected mattress sections. The top layer 28 is a flexible material so as to lie flat against the mattress as the sections are elevated.

The inflation or deflation of the air chambers is separately controlled in a conventional manner. The air bags are inflated with a pump either electric or motorized of compressed air or may be directly inflated from stored compressed gas. Referring again to FIGS. 1 and 3, the air chambers 30, 32 are connected to air pump 36 by hoses 38, 40. One end of a first hose 38 is attached to a first air outlet member of air pump 36 and the other end to air chamber 30 used to raise back section 14. One end of a second hose 40 is connected to air pump 36, or if desired a second air pump may be used, and the other end to air chamber 32 used to raise leg sections 20, 22. A power supply cord 42 is connected to the pump 36 and a power supply. Depending upon the pump used, the power cord may include an AC adapter 44. Because the pump 36 is rather small and the hoses are unobtrusive and easily connected the pump may be placed under the bed or nearby, so long as there is an electrical outlet available. It should be understood that other sources of air such as compressed air may be used.

In a preferred embodiment, a controller 46 is connected to the pump 36 to control the supply of air under pressure to the air chambers 30, 32 and allow air to exhaust from air chambers. Controller 46 has hand operated electrical switches 48, 50 for regulating the airflow through pump 36. The air chamber 30 for the back section and the air chamber 32 for the leg sections may be inflated separately or together. The controller 46 may be conveniently placed on the user's bed or on a side table nearby.

Other means of controlling the inflation and deflation of the air chambers may be used. For example, a manual control having a manual release valve or remote valve connected to a compressed air tank may also be used for inflation and deflation. Other control means might include, for example, electric control (remote) for inflation and deflation of air from wedges, pneumatic control (remote) for inflation and deflation of air from wedges, and any combination of the above.

To lift one's feet the user simply turns the switch 50 on controller 46 to the on position. Air is pumped into air chamber 32 causing the lower leg section to rise in a position level to the foundation and upper leg section to rise at an incline. When the lower leg section 22 is in the fully raised position the V-shaped cut out area 24 formed between the sides 20*a* and 22*a* of the legs sections disappears, as shown in FIG. 2. To lift one's back the same procedure is followed using switch 48.

Providing the mattress in separate sections provides several advantages. The first of which is that the various section more easily articulate as the respective section of the mattress is elevated or lowered. A second advantage of providing the mattress in sections is that the sections may be separated and easily packaged for shipment in a single box. The adjustable bed of the present invention has the advantage that it may be used with a conventional bed frame. Thus, all one needs to do to have the advantages of this invention is to replace their existing mattress with the mattress of this invention.

The main features of the bed are (1) an inflatable "wedge" or air chamber component in the back area of user; (2) an inflatable "wedge" or air chamber component in leg and foot area of user and (3) a mattress formed in sections that may be interconnected to each other. The "wedge" does not necessarily define a wedge shaped lifting component, but any inflatable shape that will effect the top surface on which the user lies.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An adjustable bed comprising:

a foundation for supporting a mattress;

a mattress formed in separate connectable sections including a back section capable of being elevated and lowered, and a leg section comprising an upper leg section and a lower leg section abutting said upper leg section, said leg sections capable of being elevated and lowered said abutting sides of said upper leg section and lower leg section are formed at an angle so that when said sections are in the lowered position, a V-shaped area is formed between said sides of said upper section and said lower section;

an inflatable air chamber positioned under said back section so as to elevate and lower said back section as said air chamber is inflated and deflated;

an air supply; and a controller for regulating the amount of air in each air chamber.

2. The adjustable bed according to claim 1 wherein said mattress further comprises a buttock section between said back section and said leg section and an inflatable air chamber positioned so as to elevate and lower said leg section as said air chamber is inflated and deflated.

3. The adjustable bed according to claim 1 wherein said foundation is a box springs.

4. The adjustable bed according to claim 1 wherein said mattress sections are connected together with zippers.

5. An adjustable bed comprising:

a foundation for supporting a mattress;

a mattress formed in separate connectable sections including a back section capable of being elevated and lowered, and a leg section comprising an upper leg section and a lower leg section abutting said upper leg section, said leg sections capable of being elevated and lowered;

an inflatable air chamber positioned under said back section so as to elevate and lower said back section as said air chamber is inflated and deflated;

an air supply;

a controller for regulating the amount of air in each air chamber; and said upper leg section, and said back section having concave areas on their underside to hold said air chambers when said air chambers are deflated.

6. The adjustable bed according to claim 5 further comprising a cushioning top layer.

7. The adjustable bed according to claim 5 wherein said foundation is a box springs.

8. The adjustable bed according to claim 5 wherein said mattress sections are connected together with zippers.

9. The adjustable bed according to claim 5 wherein the abutting sides of said upper leg section and said lower leg section are formed at an angle so that when said sections are in the unelevated position a V-shaped area is formed between said sides of said upper section and said lower section.

10. An articulated mattress comprising several separate interconnected sections including a back section capable of being elevated and lowered, a buttock section adjacent said back section, an upper leg section abutting said buttock section, and a lower leg section abutting said upper leg section capable of being elevated and lowered; and means for connecting said sections together; and said lower leg section, said upper leg section and said back section have concave areas on their underside to hold said air chambers when said air chambers are deflated.

11. The mattress according to claim 10 wherein said means for connecting said sections together are zippers.

12. The mattress according to claim 10 wherein the abutting sides of said upper leg section and said lower leg section are formed at an angle so that when said sections are in the lowered position a V-shaped area is formed between said sides of said upper section and said lower section.

* * * * *